United States Patent [19]

Young, Jr. et al.

[11] Patent Number: 5,067,646

[45] Date of Patent: Nov. 26, 1991

[54] APPARATUS FOR CONTROLLING A WEB

[75] Inventors: William O. Young, Jr.; George H. Lark, both of Spartanburg, S.C.

[73] Assignee: Young Engineering, Inc., Spartanburg, S.C.

[21] Appl. No.: 258,746

[22] Filed: Oct. 17, 1988

[51] Int. Cl.[5] ..... B65H 23/02

[52] U.S. Cl. ..... 226/015; 026/099; 226/021

[58] Field of Search ..... 226/3, 15, 16, 17, 18, 226/19, 20, 21, 22, 23; 74/29, 30, 33; 26/77, 97, 99, 226, 26, 74

[56] References Cited

U.S. PATENT DOCUMENTS

| | | | |
|---|---|---|---|
| 2,753,591 | 7/1956 | Stevens et al. | 26/97 |
| 4,068,789 | 1/1978 | Young, Jr. et al. | 228/3 |
| 4,420,108 | 12/1983 | Kallman | 226/118 X |
| 4,578,845 | 4/1986 | Young, Jr. | 26/98 |

*Primary Examiner*—Daniel P. Stodola
*Assistant Examiner*—Paul Bowen
*Attorney, Agent, or Firm*—Dority & Manning

[57] ABSTRACT

Apparatus for controlling the lateral position of a web moving along a path of travel across a scroll roll or other roll capable of imparting lateral movement to the web. The apparatus includes sensors to detect lateral position of the web and elements, preferably conical brushes, which are movable into and out of contact with the web to cause the roll when in contact to move the web in a corrective lateral direction. A mechanism is employed for imparting movement to the web contacting elements which will achieve impact of the elements against the web at a velocity approaching zero. Further, the web contacting element is adapted for pivotal movement away from the web upon contact with the web, thus permitting webs of differing thickness across a normal thickness range to be controlled without additional adjustment to the apparatus.

4 Claims, 2 Drawing Sheets

APPARATUS FOR CONTROLLING A WEB

BACKGROUND OF THE INVENTION

In the movement of an intermediate length of a web material such as might be found in the textile industry, the web oftentimes passes through a plurality of separate or related operations in an overall process. In each of these operations it is desirable and sometimes essential that the web be in a particular position with respect to the apparatus to ensure proper processing of the web without causing damage to the web or producing "off quality" goods. Since, as a general rule, the apparatus handling the web is substantially wider than the width of the web, lateral movement of the web across the apparatus is probable. Such lateral movement can create improper web alignment with respect to the particular equipment. Proper web alignment is particularly important in those processes where the web needs to be brought into registry to permit a normal process function. For example, in laminating, printing, tentering, and similar operations, a web must first be properly aligned prior to commencing of the process. Likewise, though not necessarily essential, good web alignment is greatly preferred for batching, coating, and virtually all web handling processes. Movement of the web out of the anticipated path of web travel may subject the web to unused and soiled parts of the web handling equipment.

Several techniques have heretofore been developed to control the lateral position of a moving web. Each of these techniques employs a device to detect the position of the web and to bring about a correction responsive thereto. Oftentimes these detectors include a beam of light that is directed across a predetermined area with a photo receiver being positioned on the opposite side of the web path. Once the web breaks the beam of light, or permits the light to be received by the photo conductor, as the system dictates, certain means are actuated to signal that the web is out of proper alignment. The web can then be manually or automatically adjusted to its proper path of travel to provide for further proper processing thereof.

One such technique which has been successful is described in U.S. Pat. No. 4,068,789 to Young et al. which is incorporated herein by reference. While the aforesaid arrangement of Young et al. has been successful, the present invention represents yet further improvement, in that, the present invention is operable for controlling various thickness webs without adjustment and imparts a very easy or soft force against the web for bringing about lateral corrective movement of the web.

The present invention thus represents an improvement in the art of such devices as will be described in complete detail hereinafter. There is no known prior art that would anticipate or suggest the method or apparatus of the present invention.

SUMMARY OF THE INVENTION

It is an object of the present invention to provide improved apparatus for controlling moving webs of varying thickness.

Another object of the present invention is to provide improved apparatus for controlling the lateral position of a moving web.

Another object of the present invention is to provide improved apparatus for imparting soft pressure onto a moving web to effectuate a change in the position of the web.

A further object of the present invention is to provide a method for controlling the lateral position of a moving web.

Yet another object of the present invention is to provide apparatus for detecting a fabric edge and properly aligning the lateral position of the fabric in response thereto without regard for fabric thickness.

Generally speaking, the apparatus of the present invention is directed to controlling a moving web and comprises a driven roll contactable by a web movable thereacross, said roll having means associated therewith to drive said web laterally under predetermined pressure conditions only; means to selectively apply soft pressure on said web adjacent one edge of said web only, whereby said means on said roll drives said web in the direction of increased pressure, and web detector means operatively associated with said pressure means to selectively actuate and deactuate said pressure means responsive to position of said web.

More specifically, the control system of the present invention preferably includes a scroll roll which is a roll having one helical element extending therealong, or having two helical elements wound in opposite directions, emanating from a medial portion thereof and extending outwardly toward opposite ends thereof. The point where the helices change direction may be centrally located along the roll or offset as desired. Preferably, a roll is employed where two oppositely pitched leads permit a fabric or other type web to pass along in contact with the roll with a potential transverse force extending from the central portion of the roll where the leads originate outwardly in both directions, whereby a net transverse force of zero being realized when the web is centered over same. The web thus normally moves along its intended path across such roll. When, however, an additional force is applied to the web along one edge of same, a pressure imbalance is created on one side of the roll. The helical winds on the increased pressure side of the driven roll then cause the web to receive a screw type action, whereby the web is moved laterally, in the direction of the pressure.

Apparatus of the present invention preferably includes pressure applicator means, a plurality of same being provided on each side of the fabric path, and located above the web. In conjunction with the pressure applicator means, web detector means are also associated therewith to monitor the position of the web during movement. Upon sensing a deviation of the transverse position of the web, the detector means signals the pressure applicator means on the side of the web to which the web should move to bring same back into a proper position. The particular pressure applicator means is then brought into contact with the web and the web is driven laterally in such direction. Once the web is back in proper position, the pressure means is deactuated and the web moves normally along its intended path.

A key element of the present invention is the particular type pressure applicator means that is employed. For example, a device may be employed with makes contact with the top of the web. Pressure is thus applied through the web and against the scroll roll to enable the scroll roll to move the web in the desired direction. Force should be applied in the web without producing excessive frictional forces in the axial direction with respect to the web path. Force is also applied to the web by the applicator means at near zero velocity at impact. Conical brushes in angular disposition with respect to the axial direction of web movement will roll have been used before without causing undue axial frictional forces on the web and are preferred for use in the present invention. Other pressure applicator devices will also be equally suitable and are intended to be within the scope of the present invention.

The particular pressure applicator means employed is adapted for limited upward pivotal movement at the point of impact with the web. Such pivotal movement permits apparatus according to the present invention to be used to control fabrics of a normal range of thickness without adjustment beyond that initially made. If no adjustment is made to the thickness of the fabric, the thicker the fabric, the greater the velocity of the applicator means at the point of impact. Even so, with a rotary actuator or similar type device, adjusted for harmonic motion when no adjustment is made for fabric thickness, the velocity at impact will normally be less than with apparatus utilizing a linear actuator such as a pneumatic cylinder.

Web sensors that are used to monitor the position of the web are normally positioned adjacent an edge of the web, though for certain operations, center guiding of the web is preferred. Suitable sensors include photocells, air, low force mechanical sensors, and the like.

The method of controlling according to the present invention generally comprises the steps of feeding a web across a driven roll, said roll having means thereon to move the web in a direction transverse to the normal direction of movement upon receipt of a pressure thereon, detecting the transverse position of the moving web and actuating pressure applicator means upon detecting a transverse movement of the web out of its designed axial path, whereby the pressure applicator means on the side of the web in the direction of the desired movement makes impact with the web at a velocity approaching zero and applies pressure against the web which, in turn, causes the driven roll to move same in the desired direction until a sensing means detects proper alignment, whereupon the pressure means is deactuated.

More particularly, once a moving web drifts out of proper alignment, is forced out of alignment or the like, an edge guide or other type sensor detects the misalignment. The particular sensing element then actuates a pressure means on an opposite side of the web. The actuated pressure means is brought into contact with the web at a velocity approaching zero and produces the necessary pressure imbalance to cause the driven roll to move the web transversely in the direction of pressure imbalance until the sensors determine that the web has returned to a proper position and deactuates the pressure applicator means.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENTS

Figure 1:
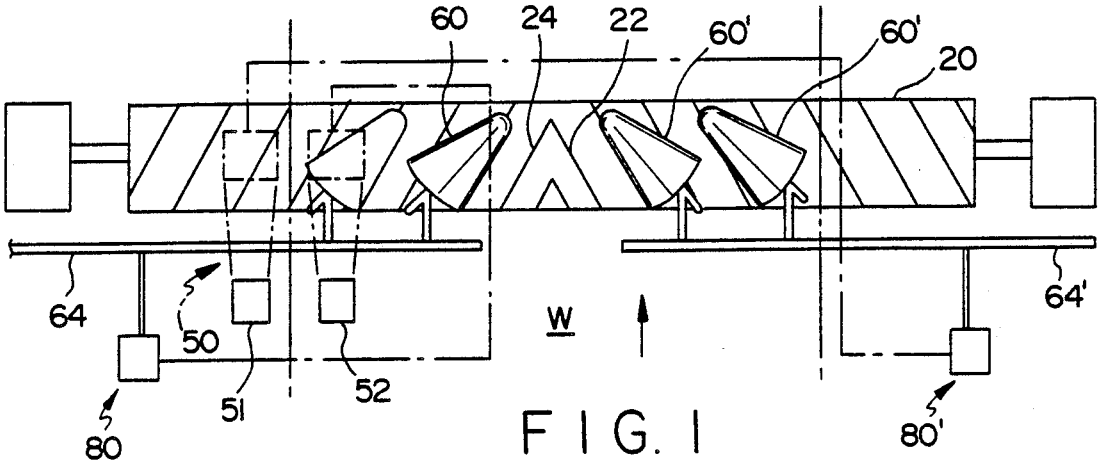
FIG. 1 is a plan view of improved control apparatus according to the present invention.

Referring to the Figures, preferred embodiments of the present invention will be described in detail. In FIG. 1, a plan schematic view of the basic method and apparatus of the present invention is illustrated. In FIG. 1, a web material W is illustrated moving along a path of travel in the direction of the arrow. Web W could be fed through a particular batching process or some other process as desired. Web W is being controlled intermediate some process to ensure that its lateral position relative to the normal path of travel is correct for the particular process. Insofar as the particular process is concerned, it could be any process for handling or treating a fabric or other web in which it is desirable or essential for the web W to be properly located in a lateral direction to the path of web travel. Without limitation, such a process could be batching, finishing, tenering, dyeing, printing, laminating, or the like. Intermediate elements may be provided to uncurl the selvages of the web if necessary and to generally provide a tight and uniform web roll. Such decurling devices may be those described in U.S. Pat. Nos. 4,578,845; 4,447,937; or 4,217,682; or any other suitable decurling device. Obviously, also other types of intermediate equipment may be utilized. In this context, the control system of the present intention is not designed for any particular type machine, but is designed for compatibility with any system or process where a length of material, such as a textile fabric, a film or the like is fed along a process path, and where transverse position of the web is an important variable.

In FIG. 1, a web W is passed over a driven roll 20 which is a scroll roll or the like. Preferably scroll roll 20 is driven in a direction opposite the direction of the web movement as indicated by the arrow. As shown in FIG. 1, helical elements 22 and 24 with opposite pitch start at a medial portion of the roll 20 and extend outwardly therefrom. Driven scroll roll 20 may, however, have only a single helical lead (not shown) therealong instead of two oppositely pitched leads, or any other surface which will cause web W to move laterally when a force is applied against web W. Where opposite pitch leads are employed, it is not necessary for them to originate at the center of the roll, and they may be offset from the center. The weight of the web W cooperating with the helices 22 and 24 of scroll roll 20 will normally cause transverse movement of web W. Since, however, the helices are of opposite pitch, the net transverse force is substantially zero if the helices originate at the center of the path of web travel, whereby the web merely moves across the helices along its intended path.

A scroll roll in an unbalanced condition where the oppositely pitched leads meet at an off center location, will drive the web in the direction of the longest lead. Almost constant corrective action will, however, offset the web driving motion and permit axial movement of the web over the roll. As web W moves axially across scroll roll 20, along its intended path of travel, numerous variances in the process can cause a simultaneous transverse movement of the web W along roll 20. This transverse movement, as mentioned above, creates difficulty in the handling of the web, for subsequent feed to a print machine for producing a precision wound roll at a take-up means or any other of the many processes in which web alignment is important. It is thus generally conventional in all web handling processes to employ an edge, center or other means as generally exemplified by the detector means generally 50 of FIG. 1, in conjunction with some means to correct the lateral position of web W when misalignment is determined by the detector means.

Numerous types of detector means are available for use in controlling a textile or other webs. Elements are available through which an edge of the material passes and which, upon physical contact, the absence of the web, pressure conditions or the like, senses the presence or absence of the web and thereafter signals a predetermined correction therefor. A further type of detector means is a photoelectric system in which a light beam is directed across an area where, depending upon the particular system employed, the web should be present or absent. A photo receiver is located on the opposite side of the web path which, again depending upon the system design, will signal misalignment of the web due to breaking of the beam or due to receipt of the beam by the receiver. Still further, center guiding may be employed whereby the edge sensors are mounted on a screw with the sensors being located at opposite edges of the web path. Upon sensing a misalignment, the second sensor signals a necessary right or left movement of the first sensor along the screw. The first sensor continues to control the pressure applicator means to properly position the lateral position of the web. In any sense, however, the detectors are designed to sense movement of web W in a transverse or lateral direction, out of proper alignment, and thereafter signal an appropriate correction therefor.

According to the teachings of the present invention, once a deviation from the normal path is sensed, a pressure applicator means is actuated on the side of the web in which corrective movement is needed. Upon actuation, the pressure application means applies an appropriate and soft pressure against web W which is transmitted to driven scroll roll 20, creating a pressure imbalance between web W and roll 20. The increased pressure on one side of the central area 21, for example, of roll 20 permits that particular helix to move web W toward the respective end of roll 20. In using a scroll roll with imbalance in the helices, a constant driving force may be experienced in the direction of the long helix. As such, an almost constant corrective pressure force is needed in the opposite direction to maintain the web in a proper location. Any corrective movement continues until the detector means senses that the web is again properly realigned whereupon the particular pressure applicator means is deactuated and the web continues to move along its intended path, unobstructed. In a preferred embodiment, means are employed to permit only intermittent actuation of the pressure means. Hence, a slack web edge will not bunch up, but will pass across roll 20 with little or no difficulty.

Pressure applicator elements according to the present invention should apply appropriate soft pressure against web W without creating any substantial frictional forces in the axial direction with respect to movement of web W. Also according to the present invention, it is preferred that at the impact of the force applicator means onto the web W, that the velocity of the force applicator means approach zero. Note, for example, that the brushes 60, 60' as shown in FIG. 1 are rotatable. Once the appropriate brushes 60, 60' are brought into contact with the web W, the appropriate helix 22 or 24 comes into play without any appreciable axial frictional force on web W. The conical brushes 60, 60' are angularly disposed such that once they are moved downwardly by rotation of the appropriate shaft 64 or 64' into contact with web W, a rolling movement is imparted to the brush. Preferably, the means for imparting force to the brushes for resultant contact with web W operates in a harmonic motion mode, and is adjusted to approach zero velocity at impact. Sufficient, but soft pressure is thus created on web W to cause transverse movement of same while at the same time avoiding production of any substantial axial frictional forces or any direct impact force that could cause damage to web W. While separate shafts 64 and 64' are illustrated, a single shaft may be employed with separate means for pivotal movement of the particular pressure applicator means. A plurality of pressure applicator elements may be employed on each side of web W as illustrated in FIG. 1.

Apparatus according to the present invention can be used on fabrics or other webs of normally varying thickness without adjustment, whether along a same length of a fabric or web or with different types of fabric. Hence, once the apparatus is adjusted for light contact against the scroll roll 20 or the like, preferably approximating zero velocity at impact, the brushes 60, 60' will thereafter be biased rearwardly by the thickness of any fabric or web W being controlled, but without significant adverse effect to the control system.

Figure 2:
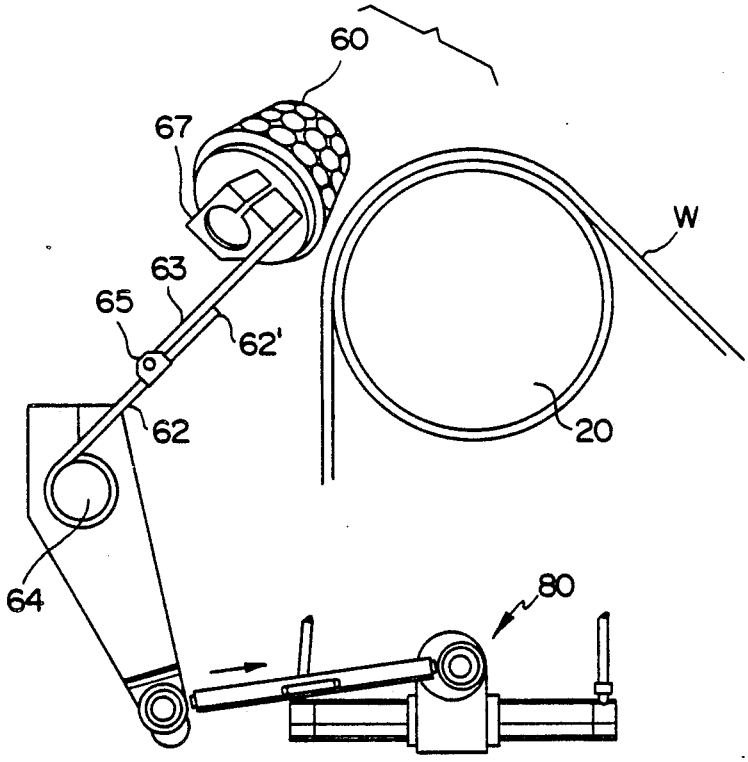
FIG. 2 is a side view of apparatus as shown in FIG. 1 illustrating the improved pressure applicator means in more detail, and out of pressure contact with the material being controlled.
Figure 4:
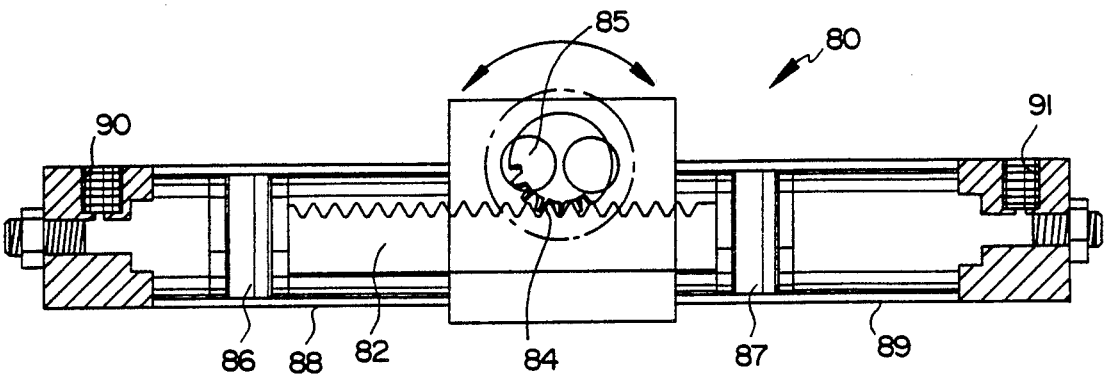
FIG. 4 is a side elevational view of a preferred means according to the present invention for generating movement to the pressure applicator means.
Figure 3:
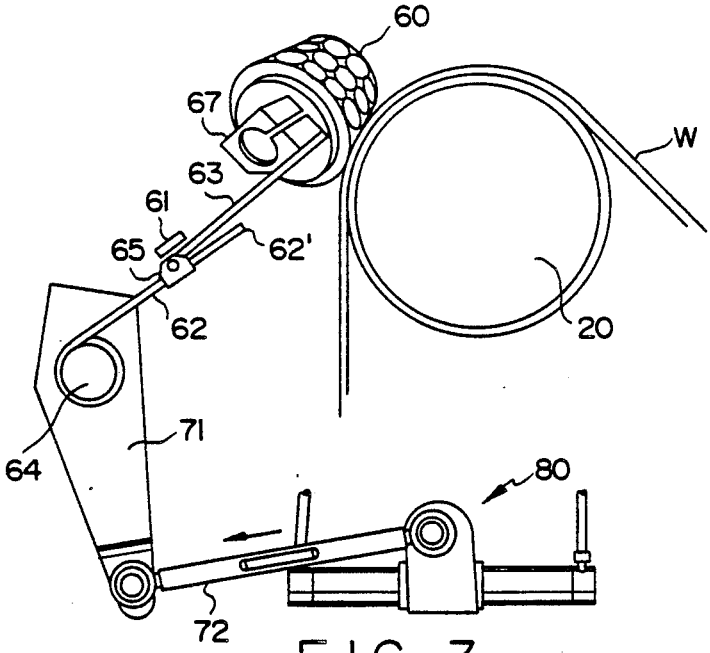
FIG. 3 is a side view of apparatus as shown in FIG. 2, but with the pressure applicator means making contact with the material being controlled.

In particular, as shown in FIGS. 2, 3 and 4, a preferred pressure applicator means will be described. Shaft 64 preferably extends along only a portion of the length of scroll roll 20 with at least one, but preferably a plurality of brush units generally 60 therealong. A support rod 62 is rigidly secured to shaft 64 and extends outwardly therefrom above the path of travel of a web W, to be controlled. Located atop support rod 62 is a pressure applicator rod 63 which is pivotally secured at an end 65 of same to support rod 62. Pressure applicator rod 63 extends beyond the terminal end 62' of support rod 62 and has a mounting block 67 secured thereat. A pressure applicator means 60, preferably a conically shaped brush is rotatably secured to mounting block 67. With brush 60 out of contact with web W, and with a scroll roll 20 as shown in FIG. 1, web W will simply pass across scroll roll 20.

With the system adjusted to bring brush 60 into light contact with scroll roll 20 at the end of forward movement, brush 60 will make appropriate contact with a fabric or other web W passing over roll 20 and cause roll 20 to move the web W laterally in the direction of the applied pressure. In a preferred arrangement, all fabrics or web W will cause some movement of brush 60 away from its support rod 62 about pivotal connection 65. Obviously, a thicker fabric will cause a greater pivotal movement (see FIG. 3). In order, however, to preclude excess pivotal movement of brush 60 away from support rod 62, a stop 61 is provided. The preferred arrangement just described will accommodate a wide range of different fabrics and thus fosters production efficiency by avoiding readjustment when webs W of differing thickness are to be processed.

In prior apparatus of the general type described above, pneumatic piston arrangements or other actuators were utilized to impart motion to the brushes and the like to move same into and out of contact with the fabric or web being controlled without any concern for the impact force of the applicator means onto web W. Adjustment of piston strokes, the length of a connector rod between the piston and the support rod for the brush or other pressure means etc. was made to accommodate and control a particular fabric. Particularly, with a piston or like arrangement, the brush or other means was brought into controlling contact at or near maximum velocity. Such is a result of the actuator arrangement, and in some cases could lead to damage to the fabric or web W.

According to the present invention, however, in a preferred arrangement, the pressure applicator means 60 approaches zero velocity at the point of impact with web W. One such arrangement for achieving the low velocity impact is illustrated in FIGS. 2, 3, and 4 which utilizes a rotary actuator adjusted for harmonic motion with respect to at least impact with web W. A lever or crankarm 71 is secured to shaft 64 at some point along its length. An opposite end of crankarm 71 is appropriately secured to a rod 72 which, in turn, is secured to rotary actuator generally 80. Rotary actuator 80 can take many forms, and are commercially available. A preferred form (see FIG. 4) includes a rack 82 in operative association with a pinion 84 through which an eccentric output shaft 85 extends. Cylinder heads 86 and 87 are located in cylinders 88 and 89 with fluid ports 90, 91, respectively therein. Introduction of fluid, preferably air into one of ports 90, 91 will move the effected cylinder head 86 or 87 and rack 82 towards the opposite cylinder. With eccentric 85 connected to rod 72, eccentric 85 will move about an arc and impart appropriate movement to crankarm 71 which, in turn, will cause partial rotation of shaft 64. Thereafter introduction of fluid into the opposite cylinder will cause a reverse motion to return shaft 64 to its starting position.

By way of example and as is preferred according to the present invention, the arrangement illustrated in FIG. 2 finds eccentric 85 in a horizontal or 0° position (shown in phantom in FIG. 4) with brush 60 out of contact with roll 20. Introduction of fluid into cylinder port 90 will cause rack 82 to move to the right, imparting a counterclockwise rotation of pinion 84. Eccentric 85 will then move to the position shown in solid in FIG. 4, moving crank arm 71 to the left and causing a downward pivotal movement of brush units 60 located along shaft 64. Fluid introduction into cylinder port 91 causes a reversal, pulling rod 72 to the right to remove brushes 60 from contact with web W to a raised position. With rotary actuator 80, a zero velocity vector is found at opposite locations say 0° and 180°, which also follows for brushes 60. Hence, if impact with web W is set to occur when eccentric 85 is in the 180° position (FIG. 3), a harmonic motion is imparted and the velocity of brushes 60 at impact will be zero. Practically speaking, if brushes 60 were rigid at the ends of support rod 62, or made no pivotal movement at contact with web W, no weight or force would be provided on web W at zero velocity impact. It is thus desirable to first adjust for brush contact with scroll roll 20. The thickness of the web W will then cause some pivotal movement of brushes 60 away from support arm 62 (see FIG. 3) to provide the needed controlling force on web W. The greater the amount of pivot of brushes 60, however, the greater the velocity of brushes 60 at impact with web W. Even so, with a harmonic motion such as achieved by a rotary actuator, velocity of the pressure applicator means at impact is adequately low that no damage to web W will occur within a normal range of thicknesses.

In operation, making reference to the Figures in particular, a web W is withdrawn from a supply source (not shown) and passes over driven scroll roll 20. The detector unit 50 senses the lateral position of web W and so long as web W passes along its intended path, i.e. between detector elements 51, 52 pressure applicator means 60 remains deactuated and web W merely passes across scroll roll 20. If, however, referring to FIG. 1 one of the detector elements 51 or 52 senses a lateral misalignment of the web W, then it is necessary to return web W to its normal path of travel. To accomplish this result, the appropriate pressure applicator means 60 or 60', preferably one or more conical brushes is actuated and is moved downwardly into contact with web W creating a pressure imbalance and causing one of the helices of scroll roll 20 to move web W in the appropriate direction. As illustrated in FIG. 1, sensor 51 will sense the web as out of line to the left, or sensor 52 will sense web W as out of line to the right. The proper pressure applicator 60 is then actuated to cause corrective web movement in the opposite direction.

Once web W is back within the confines of its normal path of travel, with an edge of same residing between sensors 51 and 52 the pressure applicator is deactuated whereby it returns to its normal position above web W and web W proceeds unimpeded across the scroll roll 20. Numerous pressure applicator elements have been mentioned herein. It has been determined that different webs are better suited to different types of pressure applicator elements. For example, in textile webs, a spun fiber that is woven into a fabric will function better with one pressure applicator element than a filament yarn that has been extruded and thereafter woven into a fabric, knitted or the like. Basic differences appear to relate to the elements that go into the makeup of the fabric and the individual frictional characteristics of same, the weight of the fabric, the construction of the fabric and the way in which the fabric is manufactured. In any event, however, all of these things may be taken into consideration so as to design an optimum system for practice of the present invention. Moreover, materials other than textile fabrics have likewise been handled according to the present invention.

In general, operation of the present invention involves a large number of small changes instead of a few large changes. Hence, pressure applicator elements are frequently actuated for short periods of time. Electronics for the operative connection of detectors and pressure applicators is conventional and need not be discussed herein. Suffice it to say that a detector upon sensing web misalignment, brings about actuation of the proper pressure applicator element.

Downstream from the web alignment means, other operation may be performed on web W. For instance, a second scroll roll may be included with opposite helix pitch which causes an opposite spreading motion to web W to treat an opposite side thereof. Likewise, adjustable tension means may be included to hold web W under very slight tension to hold same flat. Web W may further be treated by an edge uncurler to remove any curl that exists along the web selvage.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. Apparatus for imparting force against a web moving across a roll for bringing about lateral movement of the web with respect to the path of travel of the web comprising:

a) a shaft mounted for oscillation adjacent said path of travel;

b) a plurality of web contacting means located along said shaft, said web contacting means comprising a first arm secured to said shaft for oscillation therewith, a second arm located atop said first arm and being pivotally secured thereto, said second arm extending beyond an outer free end of said first arm and having an element received thereon for contact with said web;

c) shaft movement means comprising a further arm connected to said shaft and means connected to said further arm for imparting to and fro motion thereto, whereby said shaft may be oscillated to move said elements into and out of contact with a side of said web opposite said roll; and d) sensor means located along said path of travel of said web for actuating said shaft movement means when said web is sensed out of lateral alignment along said path of travel.

2. Apparatus as defined in claim 1 wherein said means for imparting to and fro motion to said shaft arm comprises a rod connected at one end to said arm and a rotary actuator connected to said rod at an opposite end.

3. Apparatus for imparting force against a web moving along a path of travel across a roll which will impart lateral movement to the web comprising:

a) a shaft mounted for oscillation adjacent said web path of travel;

b) at least one web contacting element connected to said shaft for movement toward and away from said roll;

c) means for sensing lateral position of said web at said roll; and d) actuator means connected to said shaft and being actuatable and deactuatable by said sensing means based upon detection of said web for imparting movement to said shaft to move said at least one web contacting element into and out of contact with said web, said actuator means operating to impart motion to said shaft to cause said at least one element to impact with said web at approximately zero velocity.

4. Apparatus for imparting force against a web moving across a roll for bringing about lateral movement of said web with respect to the path of travel of said web upon receipt of said force comprising:

a) a shaft mounted for oscillation adjacent said path of travel;

b) at least one web contact means connected to said shaft for movement therewith, said web contact means being movable upwardly for a limited amount upon contact with said web;

c) rotary actuator means connected to said shaft for imparting controlled movement to said shaft to bring said contacting means into contact with a side of said web at approximately zero velocity; and d) sensor means located along said path of travel of said web for actuating said rotary actuator means when said web is sensed out of alignment with said path of web travel.

* * * * *